United States Patent [19]

Krings

[11] 4,139,324

[45] Feb. 13, 1979

[54] BRACING SYSTEM GLIDE SHOE FOR TRENCH SHEETING EQUIPMENT

[76] Inventor: Josef Krings, Hans-Boeckler Str. 23, D-5138 Heinsberg-Oberbruch, Fed. Rep. of Germany

[21] Appl. No.: 858,074

[22] Filed: Dec. 6, 1977

[30] Foreign Application Priority Data

Jan. 24, 1977 [DE] Fed. Rep. of Germany ..... 2702750

[51] Int. Cl.[2] ..... E21D 5/00

[52] U.S. Cl. ..... 405/282; 248/356

[58] Field of Search ..... 61/41 A; 248/351, 356, 248/357

[56] References Cited

U.S. PATENT DOCUMENTS

| | | | |
|---|---|---|---|
| 2,574,857 | 11/1951 | Ball | 248/357 X |
| 3,323,771 | 6/1967 | Dowty | 248/357 |
| 3,881,679 | 5/1975 | Krings | 248/356 |

FOREIGN PATENT DOCUMENTS

| | | | |
|---|---|---|---|
| 2257881 | 5/1974 | Fed. Rep. of Germany | 61/41 A |
| 779791 | 7/1957 | United Kingdom | 248/357 |

*Primary Examiner*—Mervin Stein

*Assistant Examiner*—David H. Corbin

*Attorney, Agent, or Firm*—Diller, Ramik & Wight

[57] ABSTRACT

A glide shoe which is mounted on the end of a bracing device and is slidably guided within a support member of a generally C-shaped cross-section. The glide shoe includes a generally rectangular frame glidingly received within the support member and having pivotally connected thereto by means of a pivot pin an end piece which is engageable with an end of the bracing member. The end piece includes a bearing plate having a pair of bearing members extending therefrom, one on each side of the pivot pin, and there being telescoped over the bearing members and engaging the bearing plate compression springs. The compression springs react against the glide plates which bear against a bearing wall of the support member. The bearing plate is of a width less than the longitudinal opening in the support member and the bearing members are engageable with the glide plates to limit the pivoting of the bearing plate about the pivot pin. The glide plates may be in the form of a single plate and a retainer may be provided for retaining the glide plate or plates against separation from the bearing plate.

14 Claims, 7 Drawing Figures

BRACING SYSTEM GLIDE SHOE FOR TRENCH SHEETING EQUIPMENT

This invention relates to a spring supported glide shoe resting against a guide stud of a trench sheeting equipment, the glide shoe including a frame guided within the stud for sliding movement and a hinge pin extending transverse to the direction of movement of the glide shoe within the stud and serving to connect an end piece for a bracing system to the frame for relative pivoting.

West German Pat. Nos. 22 58 588 and 23 17 872 (U.S. Pat. No. 3,881,679) disclose glide shoes of this general type with there being compression or leaf springs carried by an end piece of a bracing system and resting within the frame to prevent excessive deflection of the end piece with respect to the frame. With respect to the glide shoe arrangement of German Pat. No. 23 17 872 and U.S. Pat. No. 3,881,679, one end of a leaf spring, which has a center portion thereof fastened to the bracing system end piece, resting on one side of a clearance in the frame, while the other end of the leaf spring is supported by the gliding surface or bearing wall of the guide stud. The purpose of the glide shoes of these prior patents is to prevent the bracing system from deflecting more than 5–6 degrees from the horizontal. It is not intended that the glide shoes effect an automatic return of the bracing system to the horizontal.

The bracing system should be prevented from deviating by more than 5–6 degrees from the horizontal because otherwise the cross-sectional geometry of the propped sheeting equipment would change to an inadmissible one. This is especially true in the case where the glide shoes move in tightly guided relation within the guide studs which have a generally C-shaped cross-sectional contour.

High loads were imposed on the glide shoe arrangement of German Pat. No. 22 58 588 because of the small lever arm effecting the spring compressive force. On the other hand, the leaf spring used in the glide shoe arrangement of German Pat. No. 23 17 872 and U.S. Pat. No. 3,881,679 frequently proved insufficient for the very high forces involved and would break.

This invention, therefore, is directed to the creation of a glide shoe on the general basis of the earlier glide shoes, but which is so constructed to sustain the high loads while providing for a limitation as to the pivoting of the bracing structure relative to the guide stud. At the same time the glide shoe is of a simple construction so as to be easily and inexpensively manufactured.

The glide shoe of this invention solves the prior problems by providing the end piece with a bearing plate having dimensions less than the internal dimensions of the frame and being provided with at least one bearing block on each side of the hinge pin on the face of the bearing plate facing within the guide stud. The bearing blocks guide compression springs surrounding them with the springs resting upon either individual gliding plates or a single gliding plate. The spacing between free ends of the bearing blocks and the associated gliding plate or plates is so selected that the deflection of the bearing plate relative to the frame and from the horizontal does not exceed a predetermined angle on the order of 5–6 degrees.

In accordance with this invention, the play provided between the gliding plate or plates and the bearing blocks acting as stops limit the allowed pivoting deflection while the springs progressively resist the deflection of the end piece in a dampening manner and thus eliminate sudden shifting of the bracing relative to the guide stud. Similtaneously the danger of fracture of the springs is minimized.

In accordance with this invention, there is no bracing of the end piece directly against the frame. Also, aside from the customary bracing, there is no additional bracing of the end piece relative to the guide stud for the purpose of eliminating deflection. The deflection is limited solely by the inside stop element.

According to one embodiment of the invention, each guide plate may be fastened by a threaded bolt passing through its associated bearing block so as to maintain the guide plates associated with the bearing plate and limiting the play between the plates.

It has also been found advantageous that there be a single guide plate with which all of the bearing blocks are associated.

When there is a single glide plate common to all the bearing blocks, it is feasible that the glide plate be hingedly carried by the hinge pin so as to retain its relative position with respect to the bearing plates as opposed to the use of threaded bolts. This arrangement provides for the better fastening of the glide plate with respect to the end piece so that the insertion of the glide shoe into the guide stud is facilitated. Also, because of the problem of rusting, bolts may be undesirable in certain environments and thus can be eliminated. Furthermore, manufacture and assembly are easier and more economical with this arrangement. It is also to be understood that this arrangement can be utilized with guide studs of a U-shaped cross-section.

With the above and other objects in view that will hereinafter appear, the nature of the invention will be more clearly understood by reference to the following detailed description, the appended claims, and the several views illustrated in the accompanying drawings.

Figure 1:
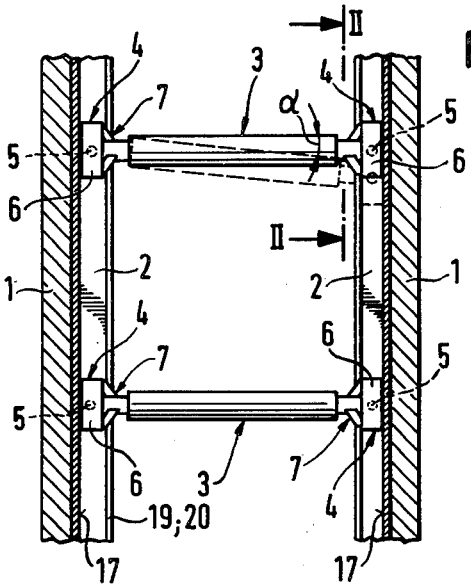
FIG. 1 is a schematic fragmentary vertical sectional view through trench sheeting equipment in accordance with this invention.

Referring now to the drawings in detail, there is illustrated in FIG. 1 components of trench sheeting equipment illustrated in schematic form. The trench sheeting equipment includes vertical sheetings 1 which are placed on opposite sides of a trench against the trench walls (not shown). The sheetings 1 are maintained by vertical guide studs 2 which may be selectively detachably or fixedly secured to the sheetings 1 and hold them in place. The guide studs are urged apart by horizontal bracing systems 3 extending between opposite guide studs. Each bracing system 3 may be formed of telescoping pipes, shafts, etc., and carry a glide shoe 4 to their free ends with the glide shoe 4 being guidingly and slidably positioned within associated guide studs 2. In the illustrated assembly, the guide stud is of a C-shaped cross-section. However, it is feasible in conjunction with at least one embodiment of the invention that the guide stud be of a U-shaped cross section. When the guide stud 2 is of a C-shaped cross-section, it includes two terminal flanges 19 which lie in a common plane and are spaced from one another to define a longitudinally extending slot 20 through which there extends an end piece 7 of the bracing system.

Each glide shoe 4 is pivotally connected by a horizontal hinge pin 5 to the end piece 7 of the respective bracing system 3, whereby each bracing system 3 may be pivoted with respect to the associated guide stud and slanted to the horizontal through an angle up to an angle $\alpha$. This slanting of the bracing system 3 may occur, for example, when adjusting the height of the bracing system or when pulling or putting into place the sheetings 1 or the guide studs 2.

For reasons of safety, the angle $\alpha$ between the horizontal and the deflected position should not exceed 5–6 degrees because otherwise the cross-sectional geometry of the sheeting equipment would vary excessively to the point where it would not be sufficiently stable.

Figure 4:
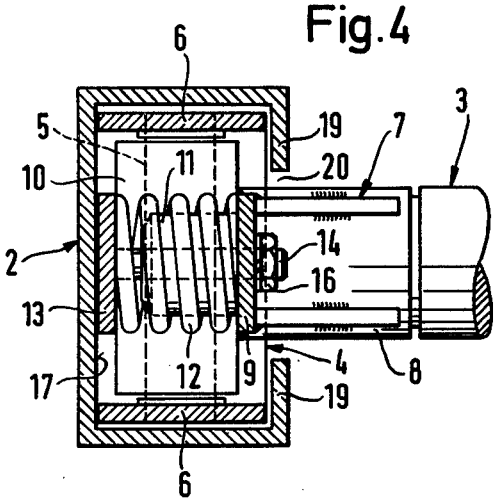
FIG. 4 is a horizontal sectional view taken along the line IV—IV of FIG. 3, and shows further the detals of the glide shoe.
Figure 2:
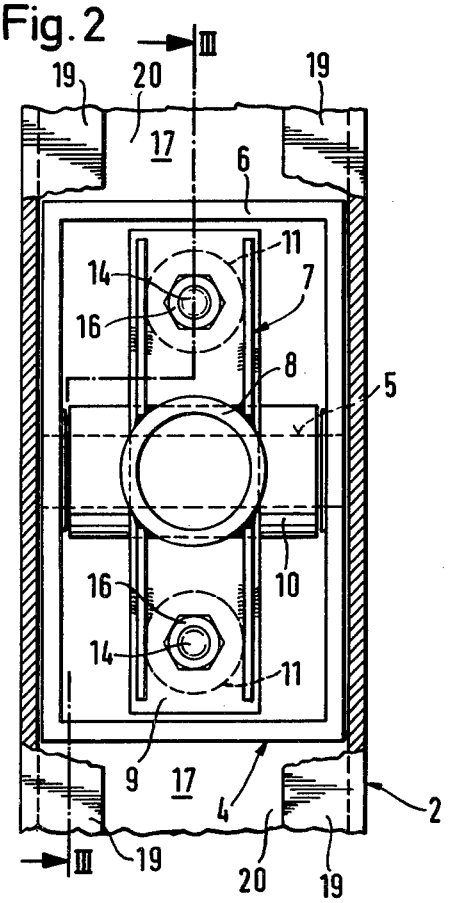
FIG. 2 is an enlarged sectional view taken along line II—II of FIG. 1 of one of the guide studs with parts broken away, and showing therein one embodiment of a glide shoe.
Figure 3:
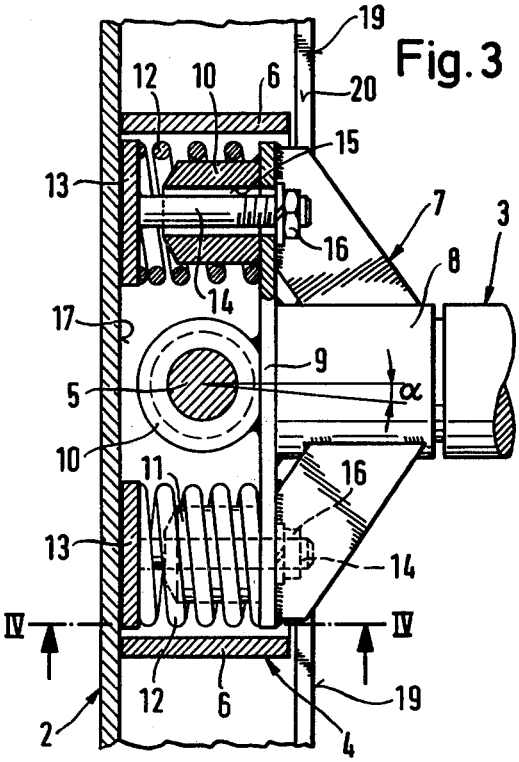
FIG. 3 is a fragmentary vertical sectional view taken along the line III—III of FIG. 2, and shows specifically the construction of the glide shoe with a bracing system attached thereto.

In FIGS. 2–4 there is illustrated a first embodiment of the glide shoe 4 which is so constructed so as to restrict deflection to the predetermined angle $\alpha$ on the order of 5–6 degrees. The glide shoe 4 includes a frame 6 which is generally rectangular in outline and is of a width to be guidingly and slidably received between the side flanges of the guide stud 2. The frame 6 is provided with bearings for the hinge pin 5, the hinge pin 5 also being carried by bearings of the end piece 7. The end piece 7 swings about the hinge pin 5 and includes a bearing plate 9 rigidly connected with a tubular sleeve 8 into which an end of a bracing system 3 may be positioned. The sleeve 8 is suitably braced relative to the bearing plate 9 and the bearing plate 9 is of a size to be received within the frame 6. When the guide stud 2 is of a C-shaped cross-section and has opposed flanges 19 defining the longitudinal opening 20, the bearing plate 9 is of a width less than the width of the opening.

The hinge pin 5 projects through a bearing 10 welded to the rear surface of the bearing plate 9 and into the frame 6. Bearing blocks 11 extend from the rear face of the bearing plate 9 on opposite sides of the hinge pin 5, as shown in FIG. 3. Each bearing block 11 is surrounded by a compression spring 12 with each compression spring 12 having its end remote from the bearing plate 9 resting against a further plate in the form of a glide plate 13. Each glide plate 13 is retained relative to the bearing plate 9 by a threaded bolt 14 which extends loosely through a bore 15 in the associated bearing block 11 and the bearing plate 9. The end of the bolt 14 extending through the bore 15 is provided with a retaining nut 16.

The glide plates 13 rest upon the main wall or web of the guide stud 19, which wall is a bearing wall and is identified by the numeral 17. The bearing blocks 11 are of a length wherein there is a predetermined space between each glide plate 13 and its associated bearing block 11 so as to permit limited tilting of the bearing plate 9 and thus the end piece 7 relative to the frame 6 and the guide stud 2. The spacing between the glide plates 13 and the bearing blocks 11 determine the magnitude of the permissible angle of tilt, angle $\alpha$. The bearing blocks 11 thereby act as limit stops while the springs 12 act to prevent abrupt transitions of the glide shoe 4 into locking positions. The springs 12 also absorb impact stresses.

While in the embodiment of FIGS. 2–4 separate glide plates 13 have been illustrated, it is to be understood that a single glide plate may be advantageously utilized in that such a glide plate prevents twisting and provides for improved guidance of the glide plate.

Figure 7:
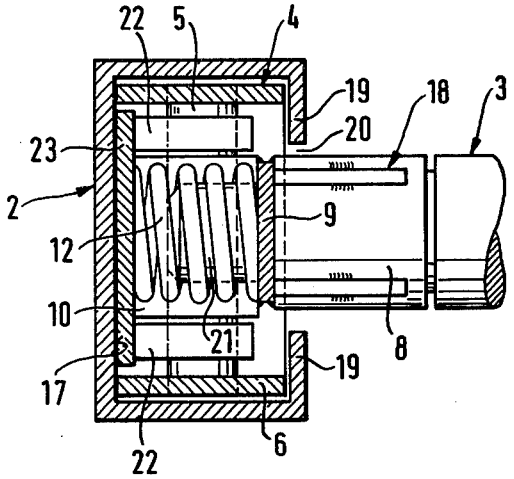
FIG. 7 is a horizontal sectional view taken along the line VII—VII of FIG. 6, and shows further the details of the glide shoe.
Figure 5:
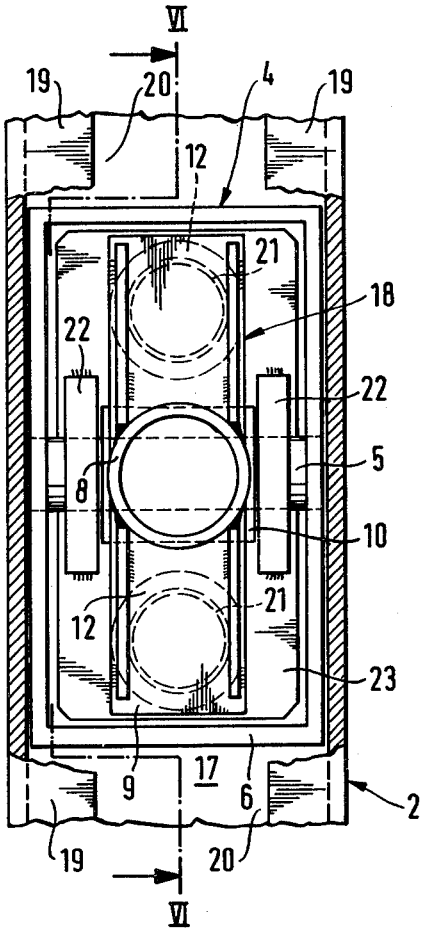
FIG. 5 is a fragmentary elevational view similar to FIG. 2, showing a modified form of glide shoe.
Figure 6:
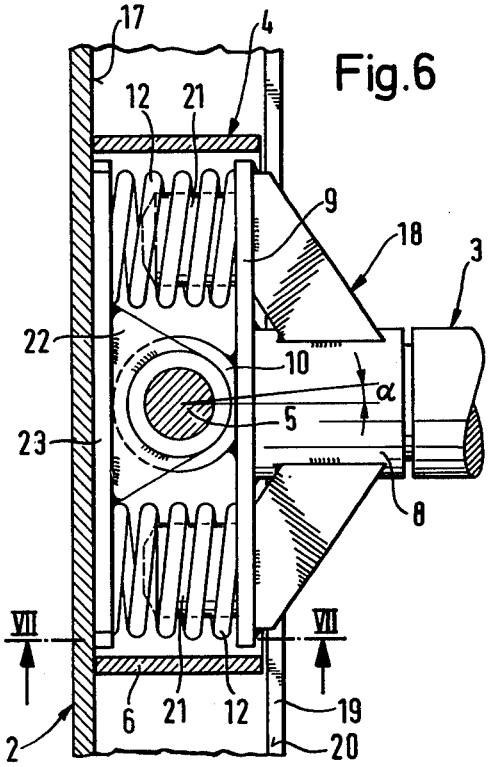
FIG. 6 is a fragmentary vertical sectional view taken along the line VI—VI of FIG. 5, and shows further the details of the glide shoe.

Reference is now made to FIGS. 5–7 wherein a modified form of glide shoe is illustrated. The glide shoe includes the same frame 6 which is pivotally connected to the bearing plate 9 by the hinge pin 5. The end piece is designated by the numeral 18 in view of the fact that it is of slightly different construction, particularly in that the bearing 10 is much shorter than the like bearing of the end piece 7. Also, the bearing plate 9 carries bearing blocks 21 and are free of through bores. Each bearing block 21 carries a compression spring 12 and the compression springs 12 bear against a single glide plate 23. The glide plate 23 is provided with bearings 22 which receive the hinge pin 5 and thus retain the glide plate 23 relative to the bearing plate 9, eliminating the need for restraining bolts.

The glide shoe arrangement of FIGS. 5–7 provides for a compact unit. If the bracing system 3 is deflected from the horizontal, one of the bearing blocks 21 will come to rest against the glide plate 23 without the glide plate 23 requiring excessive support from the support surface of the bearing wall 17. Threaded bolts are no longer required, this being a particular advantage in view of the difficulty of removing the bolts which may have become locked in place. Further, the arrangement of FIGS. 5–7 permits the glide shoe to be encapsulated or housed and the assembly thereof is simple, merely requiring the insertion of the unit into the end of the guide stud in the case of a C-shaped stud or directly into the face of the guide stud in the case of a U-shaped guide stud.

Although only preferred embodiments of the glide shoe have been specifically illustrated and described, it is to be understood that minor variations may be made in the glide shoe construction without departing from the spirit and scope of the invention as defined by the appended claims.

What is claimed as new:

1. A glide shoe and guide member assembly for use in trench sheeting equipment and the like for positioning an end of a bracing member, said guide member being of a generally U-shaped cross-section and including a bearing wall and a longitudinally extending opening remote from said bearing wall, said glide shoe including a generally rectangular outline frame positioned within said guide member for guided sliding movement, an end piece for a bracing member extending from said frame through said opening, and a pivot pin pivotally connecting said end piece to said frame, said assembly being characterized by said end piece including a bearing plate, bearing blocks extending from said bearing plate toward said bearing wall on opposite sides of said pivot pin, at least one glide plate slidably engaging said bearing wall, a compression spring associated with each bearing block and resiliently urging said glide plate against said bearing wall, and said bearing blocks having ends remote from said bearing plate spaced from said glide plate a selected distance for limiting pivoting of said bearing plate relative to said frame to a predetermined angle.

2. The assembly of claim 1 wherein there is a separate glide plate associated with each spring and bearing block.

3. The assembly of claim 1 wherein a retaining member anchored to said glide plate extends through a bore in each bearing block and said bearing plate.

4. The assembly of claim 1 wherein said glide plate is common to all of said springs and bearing blocks.

5. The assembly of claim 4 wherein said glide plate is restrained against separation from said bearing plate by a pivotal connection with said pivot pin.

6. The assembly of claim 1 wherein said guide member is of C-shaped cross-section and said opening is defined by two spaced apart terminal flanges.

7. The assembly of claim 1 wherein said bearing plate is of a width less than the width of said opening.

8. The assembly of claim 1 wherein each compression spring is telescoped over an associated bearing block.

9. The assembly of claim 1 wherein said glide plate is restrained against separation from said bearing plate by a pivotal connection with said pivot pin.

10. The assembly of claim 9 wherein said bearing plate is of a width less than the width of said opening, and each compression spring is telescoped over an associated bearing block.

11. The assembly of claim 10 wherein said glide plate is common to all of said springs and bearing blocks.

12. The assembly of claim 11 wherein said guide member is of C-shaped cross-section and said opening is defined by two spaced apart terminal flanges.

13. The assembly of claim 7 wherein a retaining member anchored to said glide plate extends through a bore in each bearing block and said bearing plate.

14. The assembly of claim 8 wherein a retaining member anchored to said glide plate extends through a bore in each bearing block and said bearing plate.

* * * * *